US005723255A

United States Patent [19]

Texter et al.

[11] Patent Number: 5,723,255

[45] Date of Patent: Mar. 3, 1998

[54] NANOPARTICULATE THERMAL SOLVENTS

[75] Inventors: John Texter, Rochester; David Alan Czekai, Honeoye Falls, both of N.Y.

[73] Assignee: Eastman Kodak Company, Rochester, N.Y.

[21] Appl. No.: 487,373

[22] Filed: Jun. 7, 1995

[51] Int. Cl.[6] ..... G03C 8/00

[52] U.S. Cl. ..... 430/203; 430/617

[58] Field of Search ..... 430/203, 617

[56] References Cited

U.S. PATENT DOCUMENTS

| | | | |
|---|---|---|---|
| 3,676,147 | 7/1972 | Boyer et al. | 430/569 |
| 4,006,025 | 2/1977 | Swank et al. | 430/567 |
| 4,474,872 | 10/1984 | Onishi et al. | 430/512 |
| 4,927,744 | 5/1990 | Henzel et al. | 430/566 |
| 4,948,718 | 8/1990 | Factor et al. | 430/522 |
| 5,240,821 | 8/1993 | Texter et al. | 430/405 |
| 5,270,145 | 12/1993 | Willis et al. | 430/203 |
| 5,352,561 | 10/1994 | Bailey et al. | 430/203 |
| 5,354,642 | 10/1994 | Texter et al. | 430/203 |
| 5,356,750 | 10/1994 | Texter et al. | 430/203 |
| 5,360,695 | 11/1994 | Texter | 430/203 |
| 5,401,623 | 3/1995 | Texter | 430/546 |
| 5,436,109 | 7/1995 | Bailey et al. . | |
| 5,494,775 | 2/1996 | Texter | 430/203 |

FOREIGN PATENT DOCUMENTS

| | | | |
|---|---|---|---|
| 0 545 433 A1 | 6/1993 | European Pat. Off. . | |
| 2138851 | 6/1987 | Japan | 430/203 |
| 62/136645 | 6/1987 | Japan . | |
| 4/73751 | 3/1992 | Japan . | |

OTHER PUBLICATIONS

J62/138851, Jun. 1987, Oya et al. English Language Translation.

*Primary Examiner*—Janet C. Baxter
*Attorney, Agent, or Firm*—Paul A. Leipold

[57] ABSTRACT

An aqueous solid particle dispersion of a thermal solvent, where said thermal solvent is a water-immiscible phenol derivative and has a melting point, $T_m$, between 30° C. and about 200° C., wherein said dispersion contains a dispersing aid, and wherein the thermal solvent particles in said dispersion are essentially nanocrystalline is disclosed. Also disclosed is a process for forming a coating comprising the steps of:

providing an aqueous solid particle dispersion of thermal solvent, where said thermal solvent is a water-immiscible phenol derivative and has a melting point, $T_m$, between 30° C. and about 200° C., and where said dispersion contains a dispersing aid;

combining said aqueous solid particle thermal solvent dispersion with a coating melt composition, where said coating melt composition is maintained at a temperature, $T_c$, during the preparation and coating of said coating melt composition, and where $T_c<T_m$;

coating said coating melt composition onto a support to form a coating;

drying said coating by means wherein the temperature of said coating is maintained less than $T_m$.

19 Claims, No Drawings

NANOPARTICULATE THERMAL SOLVENTS

RELATED APPLICATIONS

This application is related to the following copending and commonly assigned application: Thermal Solvents for Dye Diffusion in Image Separation Systems of Bailey et al., filed Dec. 6, 1991 as U.S. application Ser. No. 07/804,868.

FIELD OF THE INVENTION

This invention relates to thermal solvents for facilitating nonaqueous diffusion through hydrophilic binder in light sensitive photographic elements. More particularly, this invention relates to the particulate nature and the physical state of such thermal solvents and to dispersions of such thermal solvents.

BACKGROUND OF THE INVENTION

Langen et al., in U.K. Pat. No. 1,570,362 disclose the use of solid particle milling methods such as sand milling, bead milling, dyno milling, and related media, ball, and roller milling methods for the production of solid particle dispersions of photographic additives such as couplers, UV-absorbers, UV stabilizers, white toners, stabilizers, and sensitizing dyes.

Henzel and Zengerle, in U.S. Pat. No. 4,927,744, disclose photographic elements comprising solid particle dispersions of oxidized developer scavengers. Said dispersions are prepared by precipitation and by milling techniques such as ball-milling.

Boyer and Caridi, in U.S. Pat. No. 3,676,147, disclose a method of ball-milling sensitizing dyes in organic liquids as a means of spectrally sensitizing silver halide emulsions. Langen et al., in Canadian Patent No. 1,105,761, disclose the use of solid particle milling methods and processes for the introduction of sensitizing dyes and stabilizers in aqueous silver salt emulsions.

Swank and Waack, in U.S. Pat. No. 4,006,025, disclose a process for dispersing sensitizing dyes, wherein said process comprises the steps of mixing the dye particles with water to form a slurry and then milling said slurry at an elevated temperature in the presence of a surfactant to form finely divided particles. Onishi et al., in U.S. Pat. No. 4,474,872, disclose a mechanical grinding method for dispersing certain sensitizing dyes in water without the aid of a dispersing agent or wetting agent. This method relies on pH control in the range of 6–9 and temperature control in the range of 60°–80° C.

Factor and Diehl, in U.S. Pat. No. 4,948,718, disclose solid particle dispersions of dyes for use as filter dyes in photographic elements. They disclose that such dyes can be dispersed as solid particle dispersions by precipitating or reprecipitating (solvent or pH shifting), by ball-milling, by sand-milling, or by colloid-milling in the presence of a dispersing agent.

Iwagaki et al., in unexamined Japanese Kokai No. Sho 62[1987]-136645, disclose solid particle dispersions of heat solvent, wherein said heat solvent has a melting point of 130° C. or greater. These heat solvent dispersions are incorporated in a thermally developed photosensitive material incorporating silver halide, a reducing agent, and a binder on a support, wherein said material obtains improved storage stability. Komamura and Nimura, in unexamined Japanese Kokai No. Hei 4[1992]-73751, disclose a ball-milled dispersion of the following compound (TS-i):

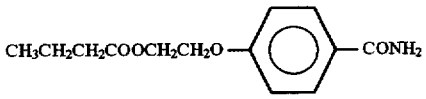

(TS-i)

A novel method of imaging, whereby conventional aqueous development processes are utilized in combination with substantially dry thermally activated diffusion transfer of image dyes to a polymeric receiver has been described by Bailey et al. in commonly assigned U.S. application Ser. No. 07/804,868, filed Dec. 6, 1991, Thermal Solvents for Dye Diffusion in Image Separation Systems, by Texter et al. in commonly assigned U.S. application Ser. No. 07/927,691, filed Aug. 10, 1992, Polymeric Couplers for Heat Image Separation Systems, and by Texter et al. in commonly assigned U.S. application Ser. No. 07/993,580, filed Dec. 21, 1992, Dye-Releasing Couplers for Heat Image Separation Systems.

The morphology of a photographic element for such systems generally consists of a (1) dimensionally stable support of transparent or reflection material, (2) a receiver layer to which the diffusible dyes migrate under thermal activation, (3) optionally a stripping layer, (4) one or more diffusible-dye forming layers in which the light image is captured and amplified during conventional aqueous color development, and (5) a protective overcoat. Latent image in the diffusible-dye forming layers is captured using well known silver halide technology and these images are amplified in conventional aqueous color development. After aqueous development the element is subjected to a stop/wash bath, dried, and then heated to drive the diffusible-dye image to the receiver. Thereafter, the support and receiver layer are separated from the diffusible-dye forming layers by a stripping method, such as that disclosed by Texter et al. in U.S. Pat. No. 5,164,280, Mechanicochemical Layer Stripping in Image Separation Systems. The separated diffusible-dye forming layers may subsequently be used as a source of recoverable silver and other fine chemicals.

Komamura and Nimura, in unexamined Japanese Kokai No. Hei 4[1992]-73751, disclose a method for forming images, where said method uses a photographic material having a support and a photosensitive silver halide layer containing dye-producing material, binder, and a thermal solvent, image exposure, liquid development, lamination of said developed material to a receiver, and heating of said laminate.

The term thermal solvent in the description and claims of the present invention refers to any organic compound that facilitates or improves the nonaqueous thermal diffusion of a heat transferable dye through a hydrophilic binder. This meaning is distinguished from other usages of this term and of related terms, such as heat solvent, used in heat developable photographic elements. These alternative usages relate to organic compounds that facilitate the nonaqueous heat development of silver halide and other silver salts, compounds that serve as solvents for incorporated developing agents, and compounds that have high dielectric constant and accelerate physical development of silver salts. These alternative usages are exemplified in the heat developable photographic elements disclosed by Henn and Miller (U.S. Pat. No. 3,347,675), Yudelson (U.S. Pat. No. 3,438,776), Bojara and de Mauriac (U.S. Pat. No. 3,667,959), La Rossa (U.S. Pat. No. 4,168,980), Baxendale and Wood (in laid open for inspection U.S. application Ser. No. 865,478, abstract published Oct. 21, 1969), Masukawa and Koshizuka (U.S. Pat. No. 4,584,267), Komamura et al. (U.S. Pat. No. 4,770,981), Komamura (U.S. Pat. No. 4,948,698), Aono and Nakamura (U.S. Pat. No. 4,952,479), Ohbayashi et al. (U.S. Pat. No. 4,983,502), Iwagaki et al. (Japanese Kokai No. Sho 62[1987]-136645), and Komamura and Nimura (Japanese Kokai No. Hei 4[1992]-73751).

Bailey et al., in commonly assigned U.S. application Ser. No. 07/804,868, filed Dec. 6, 1991, showed that thermal solvents of phenol derivatives according to the structure

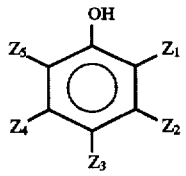

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for I is greater than 3 and less than 10; and where Hammet sigma parameters and the calculated logP parameter are described below, are particularly effective in promoting thermal dye diffusion in heat image separation systems. This effectiveness was demonstrated to be particularly applicable for facilitating thermal dye diffusion through dry gelatin. Bailey et al. also demonstrated in extensive comparative experimentation that the preferred benzamide compounds of Iwagaki et al. (Japanese Kokai No. Sho 62[1987]-136645) and of Komamura and Nimura (Japanese Kokai No. Hei 4[1992]-73751) were particularly ineffective as thermal solvents in heat image separation systems in comparison to the preferred phenol compounds of the elements and processes of the invention claims of Bailey et al. In particular, the example compound (TS-ii) of Komamura (U.S. Pat. No. 4,948,698), which differs by one methylene group from compound TS-i of

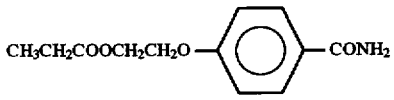

(TS-ii)

Komamura and Nimura (Japanese Kokai No. Hei 4[1992]-73751) was shown to have very poor activity for promoting thermal dye diffusion transfer of heat transferable dyes through dry gelatin.

Materials can be described by a variety of extrathermodynamic properties and parameters to relate their activity, according to some performance measure, to their structure. One of the best known of such classifications is the Hammett substituent constant, as described by L. P. Hammett in Physical Organic Chemistry(McGraw-Hill Book Company, New York, 1940) and in other organic text books, monographs, and review articles. These parameters, which characterize the ability of meta and para ring-substituents to affect the electronic nature of a reaction site, were originally quantified by their effect on the $pK_a$ of benzoic acid. Subsequent work has extended and refined the original concept and data, but for the purposes of prediction and correlation, standard sets of such constants, $_{meta}$ and $_{para}$, are widely available in the chemical literature, as for example in C. Hansch et al., *J. Med. Chem.*, 17, 1207 (1973).

Another parameter of significant utility relates to the variation in the partition coefficient of a molecule between octanol and water. This is the so-called logP parameter, for the logarithm of the partition coefficient. The corresponding substituent or fragment parameter is the Pi parameter. These parameters are described by C. Hansch and A. Leo in *Substituent Constants for Correlation Analysis in Chemistry and Biology* (John Wiley & Sons, New York, 1969). Calculated logP (often termed cLogP) values are calculated by fragment additivity treatments with the aid of tables of substituent Pi values, or by use of expert programs that calculate octanol/water partition coefficients based on more sophisticated treatments of measured fragment values. An example of the latter is the widely used computer program, MedChem Software (Release 3.54, August 1991, Medicinal Chemistry Project, Pomona College, Claremont, Calif.).

The use of these parameters allows one to make quantitative predictions of the performance of a given molecule, and in the present invention, of a given thermal solvent candidate. The Hammett parameters are routinely summed, to give a net electronic effect Σ, where Σ is the sum of the respective substituent $\sigma_{meta}$ and $\sigma_{para}$ values. Substituent and fragment parameters are readily available, so that logP and Σ estimates may be easily made for any prospective molecule of interest.

PROBLEM TO BE SOLVED BY THE INVENTION

It has previously been unrecognized that the melt mixing prior to coating of spectrally sensitized silver halide dispersions and thermal solvent dispersions can lead to desensitization and large speed losses in the photographic elements thereafter coated. This problem is particularly evident when the thermal solvent of said thermal solvent dispersion has a melting point lower than the melt hold temperature of said melt mixing or coating process. This problem is especially prevalent when said thermal solvent is a liquid at room temperature.

It has also previously been unrecognized that the melt mixing prior to and during coating of cyan coupler dispersions and thermal solvent dispersions can lead to significant inhibition of cyan coupling activity. This problem is particularly evident when the thermal solvent of said thermal solvent dispersion has a melting point lower than the melt hold temperature of said melt mixing or coating process, and is especially prevalent when said thermal solvent is a liquid at room temperature.

The crystallization of thermal solvents in amorphous thermal solvent dispersions during storage, during the preparation of photographic elements, and during the storage of photographic elements is a previously unrecognized problem in the preparation and storage of photographic elements incorporating such dispersions. Such crystallization usually leads to crystallites in excess of 10 μm in largest dimension. Said crystallites cause unwanted scattering of light in photographic elements and cause gelation of melts and clogging of filters in the coating of photographic elements.

These and other problems may be overcome by the practice of our invention.

SUMMARY OF THE INVENTION

An object of this invention is to provide thermal solvent dispersions with greatly reduced propensity to ripen into thermal solvent crystallites that clog filters and cause unwanted light scattering effects in coated photographic elements.

These and other objects of the invention are generally accomplished by providing an aqueous solid particle dispersion of a thermal solvent, where said thermal solvent is a water-immiscible phenol derivative and has a melting point, $T_m$, between 30° C. and about 200° C., wherein said dispersion contains a dispersing aid, and wherein the thermal solvent particles in said dispersion are essentially nanocrystalline. In a preferred embodiment of the present invention, these objects are obtained by providing a process for forming a coating comprising the steps of:

providing an aqueous solid particle dispersion of thermal solvent, where said thermal solvent is a water-immiscible phenol derivative and has a melting point, $T_m$, between 30° C. and about 200° C., and where said dispersion contains a dispersing aid;

combining said aqueous solid particle thermal solvent dispersion with a coating melt composition, where said coating melt composition is maintained at a temperature, $T_c$, during the preparation and coating of said coating melt composition, and where $T_c<T_m$;

coating said coating melt composition onto a support to form a coating;

drying said coating by means wherein the temperature of said coating is maintained less than $T_m$.

ADVANTAGEOUS EFFECT OF THE INVENTION

The solid particle thermal solvent dispersions of the present invention greatly reduce the propensity for thermal solvent induced desensitization of silver halide during melt hold and coating processes. This reduction advantageously provides greater robustness in the variability of emulsion sensitivity and color quality in color photographic elements incorporating said dispersions. The solid particle thermal solvent dispersions of the present invention also greatly reduce and largely eliminate cyan coupling activity inhibition, in comparison to thermal solvents dispersions not of the present invention. This reduction of coupling activity inhibition advantageously provides greater cyan dye densities with lower quantities of developed silver, and also provides improved cyan dye hues. In addition, thermal solvent ripening into large crystallites greater than about 10 μm in average dimension that clog filters, form interconnected gel structures and networks, and cause unwanted light scattering effects in coated photographic elements is greatly reduced.

DETAILED DESCRIPTION OF THE INVENTION

The term thermal solvent refers to any organic compound that facilitates or improves the nonaqueous thermal diffusion of a heat transferable dye through a hydrophilic binder. This term is distinguished from related terms, such as heat solvent, used in heat developable photographic elements which relate to organic compounds that facilitate the nonaqueous heat development of silver halide and other silver salts.

The term heat transferable dye refers to any dye that will diffuse through a hydrophilic binder when heated without the need for said binder to be in a water swollen or wetted state. Such diffusion would occur, for example, through gelatin that contains less than 20% by weight water. Such dyes, furthermore, do not contain solubilizing groups meant to immobilize dyes in relatively dry gelatin, as taught by Masukawa et al. in U.S. Pat. No. 4,584,267.

The term solid particle dispersion means a dispersion of particles wherein the physical state of particulate material is solid rather than liquid or gaseous. This solid state may be an amorphous state or a crystalline state. The expression nanocrystalline when applied to nanoparticulate thermal solvents of the present invention means that these thermal solvent particles are in a crystalline physical state, and further that said particles have a number-mean average size less than 1000 nm in largest dimension.

The term "nondiffusing" used herein as applied to the couplers and diffusible-dye forming compounds has the meaning commonly applied to the term in color photography and denotes materials, which for all practical purposes, do not migrate or wander through water swollen organic colloid layers, such as gelatin, comprising the sensitive elements of the invention at temperatures of 40° C. and lower. The term "diffusible" as applied to dyes formed from these "nondiffusing" couplers and compounds in the processes has somewhat of a converse meaning and denotes materials having the property of diffusing effectively through relatively dry colloid layers of the sensitive elements in the presence of the "nondiffusing" materials from which they are derived. The terms "dye-receiving" and "image-receiving" are used synonomously herein. In the following discussion of suitable materials for use in the elements and methods of the present invention, reference is made to *Research Disclosure*, December 1989, Item 308119, pages 993–1015, published by Kenneth Mason Publications, Ltd., Emsworth, Hampshire PO10 7DQ, United Kingdom, the disclosure of which is incorporated herein in its entirety by reference. This publication is identified hereafter as "Research Disclosure".

The term aqueous developable refers to a light sensitive photographic element that can be effectively developed by aqueous color developer solution at normal processing temperatures of 20°–45° C. Such elements are routinely coated with hydrophilic binders, such as gelatin, where said binders swell upon contact with aqueous solutions.

Thermal solvents may be added to any layer(s) of the photographic element, including interlayers, imaging layers, and receiving layer(s), in order to facilitate transfer of dye to said receiving layer(s). Any organic compound that facilitates dye diffusion through hydrophilic binders such as gelatin, polyvinylalcohol, and polyvinylpyrrolidone is suitable as a thermal solvent in the elements and processes of the present invention so long as its melting point is between 30° C. and about 200° C., and so long as it can be dispersed as a solid particle dispersion. This lower limit of 30° C. is selected because it insures that the thermal solvent particles remain in the solid state during storage of the solid particle dispersion in most room temperature storage situations. In certain embodiments it is preferred that the melting point $T_m$ of the solid particle dispersion thermal solvents of the present invention be greater than 50° C. and less than about 200° C., so as to insure that the thermal solvent particles remain in the solid state during storage of the solid particle dispersion and during the preparation of coating melts incorporating said dispersions and thermal solvents, during the coating of said melts, and during any aqueous development of elements incorporating said dispersions. Such coating melt preparation, coating, and aqueous development is typically done at temperatures in the range of 20°–45° C., and solid particle thermal solvent dispersions of thermal solvents melting at 50° C. or greater are therefore expected to interact minimally with sensitized silver halide and the development chemistry, to thereby yield less variability in image formation. The upper limit of about 200° C. is selected because this is about the upper limit of temperature that can be applied at equilibrium to the more thermally robust supports available. The thermal solvent of the present invention must be in a liquid, wetted, or non-solid state during the heated dye-transfer step or thermal activation step in uses of elements comprising the solid particle thermal solvents of the present invention. It is preferred that such thermal solvents be immiscible with water so that they do not wash out of photographic elements during aqueous development of said elements and in said processes. Suitable thermal solvents include 3-hydroxy benzoates, 4-hydroxy benzoates, 3-hydroxy benzamides, 4-hydroxy benzamides, 3-hydroxyphenyl acetamides, and 4-hydroxyphenyl aceramides that have melting points between 30° C. and about 200° C. Thermal solvents suitable for the dispersions, elements, and processes of the present invention have been disclosed by Bailey et al. in commonly assigned U.S. application Ser. No. 07/804,868, filed Dec. 6, 1991 and incorporated herein by reference. Other suitable thermal solvents that have melting points between 30° C. and about 200° C. include amides, hydrophobic ureas, benzamides, and alkyl and aryl sulfonamides as disclosed in formulae I-IV of unexamined Japanese Kokai Sho 62[1987]-136645 of Iwagaki et al., the disclosure of which is incorporated herein by reference.

Preferred thermal solvents have the structure:

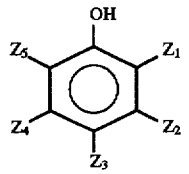

wherein (a) $Z_1$, $Z_2$, $Z_3$, $Z_4$, and $Z_5$ are substituents, the Hammet sigma parameters of $Z_2$, $Z_3$, and $Z_4$ sum to give a total, $\Sigma$, of at least −0.28 and less than 1.53;

(b) the calculated logP for I is greater than 3 and less than 10; and have melting points between 30° C. and about 200° C.

Suitable examples of said thermal solvents include aryl and alkyl esters of 3-hydroxy benzoic acid and of 4-hydroxy benzoic acid, 3-hydroxy benzamides, and 4-hydroxy benzamides.

Particularly preferred among such thermal solvents are 3-hydroxy benzoates and 4-hydroxy benzoates.

Since the activity of said thermal solvents is dependent on their being able to interact strongly with the binder and diffusing dyes in light-sensitive elements of the present invention, during the heated transfer of dye-diffusion, it is preferred that said solvents have melting points below 200° C. It is particularly preferred that said thermal solvents have melting points, $T_m$, below 160° C., so that the photographic elements of the present invention do not have to be heated excessively during heat transfer of dye. It is most preferred that said thermal solvents have melting points, $T_m$, below 130° C., so that the photographic elements of the present invention can be coated on paper base supports and heated without concern for the blistering of said support during heat transfer of dye. Thermal solvents of the present invention having $T_m$ in the range of 50° C. to 160° C. are preferred because they offer greater thermal storage stability and minimize the heating required to activate their use. More preferred are thermal solvents of the present invention having $T_m$ in the range of 50° C. to 130° C., because of the increased storage thermal stability obtained and the lower maximum heating temperature required to activate their use.

In a given layer, through which dye diffusion transfer is desired, thermal solvent is typically added at up to 300% by weight of binder in said layer. Preferably, said thermal solvent is added at 50 to 120% by weight of binder in said layer. The total thermal solvent incorporated as a solid particle dispersion in an element typically is 5 to 200% by weight of the total binder and is preferably 50 to 120% by weight of the total hydrophilic binder coated therein.

The invention colloidal dispersions of thermal solvents can be obtained by many methods for imparting mechanical shear well known in the art, such as those methods described in U.S. Pat. Nos. 2,581,414 and 2,855,156 and in Canadian Patent No. 1,105,761, the disclosures of which are incorporated herein by reference. These methods include solid-particle milling methods such as ball-milling, pebble-milling, roller-milling, sand-milling, bead-milling, dyno-milling, Masap-milling, and media-milling. These methods further include colloid milling, milling in an attriter, dispersing with ultrasonic energy, and high speed agitation (as disclosed by Onishi et al. in U.S. Pat. No. 4,474,872 and incorporated herein by reference). Ball-milling, roller-milling, media-milling, and milling in an attriter are preferred milling methods because of their ease of operation, clean-up, and reproducibility. Nanocrystalline thermal solvents are preferred in the preparation of solid particle thermal solvent dispersions when these preferred milling methods are used.

Alternatively, solid particle dispersions of thermal solvents, wherein said thermal solvent is present in an amorphous physical state, may be prepared by known methods including colloid milling, homogenization, high speed stirring, and sonication methods. The amorphous physical state of said thermal solvent may be transformed into a microcrystalline physical state by methods including thermal annealing and chemical annealing. Thermal annealing methods include temperature programmed thermal cycling to temperatures above any glass transition temperature of the amorphous coupler. Preferred thermal annealing comprises cycling said dispersion over the temperature range of 17° to 90° C. Said cycling may comprise any sequence of temperature changes that promotes microcrystalline phase formation from an extant amorphous physical state. Typically the duration of high temperature intervals are chosen to activate said phase formation while minimizing particle growth from ripening and collision processes. Chemical annealing methods include incubation with chemical agents that modify partitioning of thermal solvents and surfactants between the continuous phase of said dispersion and the discontinuous phase. Such agents include hydrocarbons (such as hexadecane), surfactants, alcohols (such as butanol, pentanol, and undecanol), and high boiling organic solvents. Said agents may be added to the dispersion during or subsequent to particle formation. Said chemical annealing may include incubating said dispersion at 17° to 90° C. in the presence of said agent, stirring said dispersion in the presence of said agent, adding said agent and then removing it slowly by diafiltration methods.

The formation of colloidal dispersions in aqueous media usually requires the presence of dispersing aids such as surfactants, surface active polymers, thickening agents, and hydrophilic polymers.

Suitable dispersing aids for the dispersions of the present invention have been disclosed by Chari et al. in U.S. Pat. No. 5,008,179 (columns 13–14) and by Bagchi and Sargeant in U.S. Pat. No. 5,104,776 (see columns 7–13) and are incorporated herein by reference. Preferred dispersing aids include sodium dodecyl sulfate (DA-1), sodium dodecyl benzene sulfonate (DA-2), sodium bis(2-ethyl hexyl) sulfosuccinate (DA-3), Aerosol-22 (Cyanamid), sodium bis (1-methyl pentyl)sulfosuccinate (DA-4), sodium bis (phenylethyl)sulfosuccinate (DA-5), sodium bis(β-phenyl ethyl)sulfosuccinate (DA-6), sodium bis(2-phenyl propyl) sulfosuccinate (DA-7), and the following:

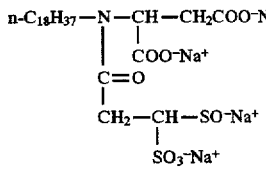

(DA-8)

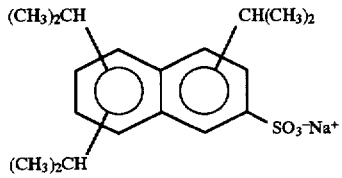

(DA-9)

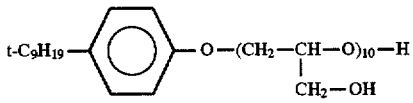

(DA-10)

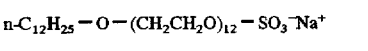

(DA-11)

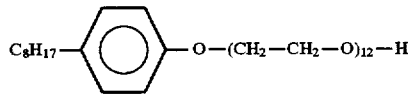

(DA-12)

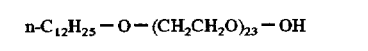

(DA-13)

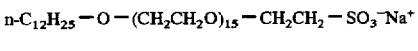

(DA-14)

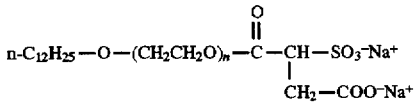

(DA-15)

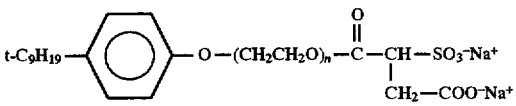

(DA-16)

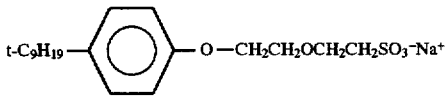

(DA-17)

Thickening agents suitable as dispersing aids for the thermal solvents of the present invention include hydrophobically modified polyacrylic acid polymer emulsion stabilizers as described in U.S. Pat. Nos. 3,915,921, 4,421,902, 4,509,949, 4,923,940, 4,996,274, 5,004,598, and 5,338,345, the disclosures of which are incorporated herein by reference for all they disclose about polymeric stabilizers. These polymers have a large water-loving portion (polyacrylate portion) and a smaller surface-loving portion (typically derived form a long carbon chain acrylate ester). These polymers can be dissolved in water. Base neutralization causes the formation of a gel, with concomitant thickening. Suitable polymers are sold as Carbopol® 1342 (a copolymer of acrylic acid and a long chain alkyl methacrylate), Carbopol® 1382 (hydrophobically modified, crosslinked acrylic acid polymer), and high molecular weight hydrophobically modified Carbopol® 1621, Carbopol® 1622, Carbopol® 1623, Pemulan® TR1, and Pemulan® TR2, all available from BFGoodrich. Another useful composition is Rheolate® 5000, available from Rheox Inc., Heighstown, N.J.

Carbopol® 1342 and Pemulan® TR2 are preferred, as also is a composition derived from a monomeric mixture containing:

(a) 95.9 to 98.8 weight percent of an olefinically unsaturated carboxylic monomer selected form the group consisting of acrylic, methacrylic, and ethacrylic acids, (b) about 1 to about 3.5 weight percent of an acrylate ester of the formula:

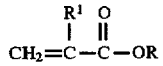

wherein R is an alkyl radical containing 10 to 30 carbon atoms and $R^1$ is hydrogen, methyl, or ethyl, and (c) 0.1 to 0.6 weight percent of a polymerizable crosslinking polyalkenyl polyether of a parent alcohol containing more than one alkenyl ether group per molecule wherein the parent alcohol contains at least 3 carbon atoms and at least 3 hydroxyl groups.

Suitable hydrophilic polymers for use as dispersing aids in the dispersions of the present invention include gelatin, polyvinylalcohol, and polyvinylpyrollidone. Such dispersing aids are typically added at level of 1%–200% of dispersed thermal solvent (by weight), and are typically added at preferred levels of 3%–30% of dispersed thermal solvent (by weight). Hydrophilic polymers may be added to the thermal solvent dispersions of the present invention before, during, and after milling to effect particle size reduction.

Colloidal solid particles of thermal solvent having a number-mean size less than 1000 nm in largest dimension are preferably obtained because of their propensity to scatter less light than larger particles. More preferably because of even less scattering of light, colloidal thermal solvent particles having a number-mean size less than 100 nm in largest dimension are obtained.

Coating melt compositions of the processes of the present invention comprise solid particle thermal solvent dispersion of the present invention, a coating solvent such as water, methanol, other water-miscible organic solvent, or water-immiscible high vapor pressure organic solvent such as ethyl acetate. Water is a preferred coating solvent because of its low toxicity. Such coating melt compositions of the present invention also typically contain binder. Hydrophilic binders are preferred. Preferred binders are gelatin, polyvinylalcohol, and polyvinylpyrollidone.

Such coating melt compositions of the processes of the present invention may contain any chemical component suitable for the intended function of the layer to be coated out of this composition. Such materials include sensitizers, desensitizers, brighteners, antifoggants, stabilizers, color materials, absorbing materials, scattering materials, vehicles, vehicle extenders, hardeners, coatings aids, plasticizers, lubricants, antistats, and matting agents as described in sections IV–XVI in Research Disclosure. Dye forming couplers that form indoaniline dyes upon reaction with the oxidation product of primary amine color developing agents such as paraphenylenediamines are preferred color materials. Phenol-based and naphthol-based cyan couplers are preferred. Particularly preferred phenol-based and naphthol-based couplers are C-I, C-II, C-III, and C-IV:

C-I

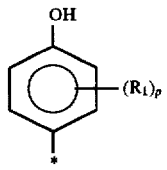

-continued

C-II

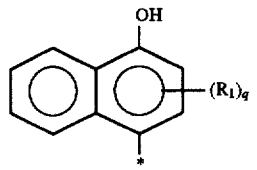

C-III

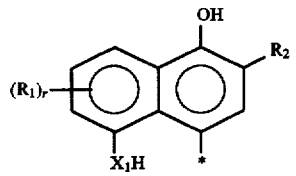

C-IV

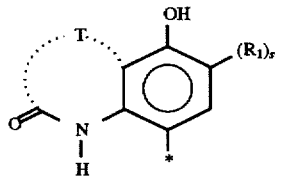

In formulae C-I, C-II, C-III, and C-IV above:

$R_1$ has 0 to 30 carbon atoms and represents a possible substituent on the phenol ring or naphthol ring. It is an alkyl group, an alkenyl group, an alkoxy group, an alkoxycarbonyl group, a halogen atom , an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group, an arylureido group, hydroxyl group, amino group, carboxyl group, sulfo group, heterocylcic group, carbonamido group, sulfonamido group, carbamoyl group, sulfamoyl group, ureido group, acyloxy group, aliphatic oxy group, aliphatic thio group,, aliphatic sulfonyl group, aromatic oxy group, aromatic thio group, aromatic sulfonyl group, sulfamoyl amino group, nitro group, or imido group.

$R_2$ represents $—CONR_3R_4$, $—NHCOR_3$, $—NHCOOR_5$, $NHSO_2R_5$, $—NHCONR_3R_4$, or $NHSO_2R_3R_4$. $R_3$ and $R_4$ each represent a hydrogen atom, aliphatic group having 1 to 30 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di-t-amylphenoxy-propyl, and 2,4-di-t-amylphenoxybutyl), aromatic group having from 6 to 30 carbon atoms (such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_5$ represents an aliphatic group having from 1 to 30 carbon atoms (such as methyl, ethyl, butyl, methoxyethyl, n-decyl, n-dodecyl, and n-hexadecyl), aromatic group having from 6 to 30 carbon atoms (such as phenyl, tolyl, 4-chlorophenyl, and naphthyl), or heterocyclic group (such as 2-pyridyl, 4-pyridyl, and 2-furyl). $R_3$ and $R_4$ may join each other to form a heterocyclic ring (such as morpholine ring, piperidine ring, and pyrrolidine ring); p is an integer form 0 to 3; q and r are integers from 0 to 4; s is an integer from 0 to 2.

$X_1$ represents an oxygen atom, sulfur atom, or $R_6N<$group, where $R_6$ represents a hydrogen atom or monovalent group. When $R_6$ represents a monovalent group, it includes, for example, an aliphatic group having from 1 to 30 carbon atoms (such as methyl, ethyl, butyl, methoxyethyl, and benzyl), aromatic group having from 6 to 30 carbon atoms (such as phenyl and tolyl), heterocyclic group having from 2 to 30 carbon atoms (such as 2-pyridyl and 2-pyrimidyl), carbonamido group having from 1 to 30 carbon atoms (such as formamido, acetamido, N-methylacetamido, toluenesulfonamido, and 4-chlorobenzenesulfonamido), imido group having from 4 to 30 carbon atoms (such as succinimido), $—OR_7$, $—SR_7$, $—COR_7$, $—CONR_7R_8$, $—COCOR_7$, $—COCOR_7R_8$, $—COOR_7$, $—COCOOR_9$, $—SO_2R_9$, $—SO_2OR_9$, $—SO_2NR_7R_8$, or $—NR_7R_8$. $R_7$ and $R_8$, which may be the same or different, each represent a hydrogen atom, aliphatic group having from 1 to 30 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di-t-amylphenoxypropyl, and 2,4-di-t-amylphenoxybutyl), aromatic group having from 6 to 30 carbon atoms (such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_7$ and $R_8$ may join each other to form a heterocyclic ring (such as morpholine group and piperidino group). $R_9$ may include, for example, those substituents (excluding a hydrogen atom) exemplified for $R_7$ and $R_8$.

T represents a group of atoms required to form a 5-, 6-, or 7-membered ring by connecting the carbon atoms. It represents, for example $$—O—,\ —\underset{R'}{\underset{|}{N}}—,\ —\underset{O}{\underset{\|}{C}}—,\ —S—,\ —N=,\ =N—,$$

$$—\underset{R'}{\underset{|}{C}}=,\ =\underset{R'}{\underset{|}{C}}—,\ \text{or}\ —\overset{R'}{\overset{|}{\underset{R''}{\underset{|}{C}}}}—,$$

or a combination thereof. In the formulae above, R' and R" each represent a hydrogen atom, alkyl group, aryl group, halogen atom, alkyloxy group, alkyloxycarbonyl group, arylcarbonyl group, alkylcarbamoyl group, arylcarbamoyl group or cyano group.

The preferred substituent groups in the present invention are exemplified in the following:

$R_1$ includes a halogen atom (such as fluorine, chlorine, and bromine), aliphatic group (such as methyl, ethyl, and isopropyl), carbonamido group (such as acetamido and benzamido), and sulfonamido (such as methanesulfonamido and toluenesulfonamido).

$R_2$ includes $—CONR_3R_4$ (such as carbamoyl, ethylcarbamoyl, morpholinocarbonyl, dodecylcarbamoyl, hexadecylcarbamoyl, decyloxypropyl, dodecyloxypropyl, 2,4-di-tert-amylphenoxypropyl, and 2,4-di-t-amylphenoxybutyl). $X_1$ includes $R_6N<$, wherein $R_6$ is preferably $—COR_7$ (such as formyl, acetyl, trifluoroacetyl, benzoyl, pentafluorobenzoyl, and p-chlorobenzoyl), $—COOR_9$ (such as methoxycarbonyl, ethbxycarbonyl, butoxycarbonyl, dodecyloxycarbonyl, methoxyethoxycarbonyl, and phenoxycarbonyl), $—SO_2R_9$ (such as methanesulfonyl, ethanesulfonyl, butanesulfonyl, hexadecanesulfonyl, benzenesulfonyl, toluenesulfonyl, and p-chlorobenzensulfonyl), $—CONR_7R_8$ (such as N,N-dimethyl carbamoyl, N,N-diethylcarbamoyl, N,N-dimethylcarbamoyl, N,N-diethylcarbamoyl, N,N-dibutylcarbamoyl, morpholinocarbonyl, piperidinocarbonyl, 4-cyanophenylcarbamoyl, 3,4-dichlorophenylcarbamoyl, and 4-methanesulfonylphenylcarbamoyl, and N,N-dibutylcarbamoyl), and $—SO_2NR_7R_8$ (such as N,N-dimethylsulfamoyl, N,N-diethylsulfamoyl, and N,N-dipropylsulfamoyl). Particularly preferred examples of $R_6$ are those groups represented by —$COR_7$, —$COOR_9$, and —$SO_2R_9$.

$R_1$ may be substituted. Preferred substituents are aryl groups (such as phenyl), nitro group, hydroxy group, cyano group, sulfo group, an alkoxy group (such as methoxy), an aryloxy group (such as phenoxy), an acyloxy group (such as acetoxy), an acylamino group (such as acetylamino), an alkylsufonamido group (such as methanesulfonamido), an alkylsulfamoyl group (such as fluorine atom, chlorine atom, bromine atom), carboxyl group, an alkylcarbamoyl group (such as methylcarbamoyl), an alkoxycarbonyl group (such as methoxycarbonyl), an alkylsulfonyl group (such as methylsulfonyl), an alkylthio group (such as β-carboxyethylthio), etc. In the case that said group is substituted by two or more of said substituents, these substituents may be the same or different. The preparation of such couplers is described, for example, in U.S. Pat. Nos. 2,367,531, 2,423,730, 2,474,293, 2,772,162, 2,801,171, 2,895,826, 3,002,836, 3,034,892, 3,041,236, 3,419,390, 3,476,565, 3,779,763, 3,996,252, 4,124,396, 4,248,962, 4,254,212, 4,296,200, 4,333,999, 4,443,536, 4,457,559, 4,500,635, 4,526,864, and 4,874,689, the disclosures of which are incorporated herein in their entirety.

Coating melt compositions of the processes of the present invention are prepared in any suitable way well known in the art, and typically are prepared in temperature controlled kettles or reactors of suitable volume. Stirring may be by any suitable means, and typically comprises convection induced by a marine type propeller. In the processes of the present invention, the temperature of the coating melt compositions is maintained at a temperature $T_c$. This temperature $T_c$ is less than the melting point $T_m$ of the thermal solvent of the present invention included in this coating melt composition. Typical methods suitable for preparing and coating such compositions and drying the resulting coatings are described in sections XIV and XV of Research Disclosure.

The advantages of the present invention will become more apparent by reading the following examples. The scope of the present invention is by no means limited by these examples, however.

EXAMPLES 1–8

Magenta dye-forming coupler M-1 is dispersed by colloid milling an ethyl acetate (36 g) solution of M-1 (12 g) with an aqueous gelatin solution comprising 4.8 of 10% (w/w) aqueous DA-9, about 43.3 g of 8.3% aqueous gelatin, and about 24 g of water. The resulting dispersion is washed to remove ethyl acetate

M-1

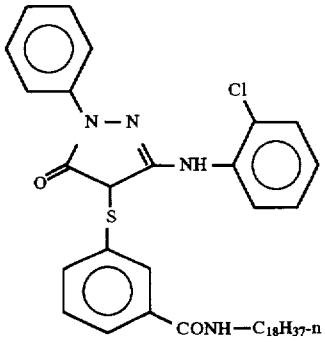

A comparison thermal solvent dispersion 4-hydroxy-(2'-ethylhexyl) benzoate (TS-1), a liquid at room temperature, is prepared by similar means. An aqueous solution of 10% (w/w) aqueous DA-9 (6 g), 8.3% aqueous gelatin (about 54 g), and water (74.9 g) is combined with 15 g TS-1, stirred, passed through a colloid mill 5 times, chill set, and stored in the cold until it is used for melt preparation. This colloid milled dispersion is designated a TS-1 CM dispersion. A solid particle thermal solvent dispersion of 4-hydroxy-nonyl benzoate (TS-2; Pfaltz and Bauer; melting point 90°–93° C.) is prepared similarly. About 12 g of TS-2 was dissolved in 24 g of ethyl acetate and mixed with an aqueous gelatin solution comprising 4.8 g of 10% (w/w) aqueous DA-9, 43.3 g of 8.3% (w/w) aqueous gelatin, and 35.9 g of water to give a crude dispersion. This dispersion is passed through a colloid mill 5 times, chill set, noodled, washed to remove ethyl acetate, remelted, chill set, and stored in the cold until used for melt preparation. This colloid milled dispersion is designated TS-2 (CM). Another solid particle thermal solvent dispersion of TS-2 is prepared by roller milling methods. About 18 g of TS-2 is combined with 36 g of 10% aqueous DA-9 , 66 g of water, and about 100 mL of 1.8–2.1 mm-diameter zirconia milling media and placed in a sealed glass jar. This jar is placed on a roller mill for about 123 hours, and a fine particle sized aqueous dispersion is obtained. This dispersion is passed through a cloth filter. About 110 g of this filtrate is combined with about 55.3 g of 8.3% (w/w) aqueous gelatin and 1.9 g of water at about 40° C., stirred, chill set, and stored in the cold until it is used for melt preparation. This roller milled dispersion is designated TS-2 RM.

A cubic AgCl emulsion of 0.30 μm edge length is spectrally sensitized with the tetrabutyl ammonium salt of sensitizing dye SD-1. About 300 mg SD-1 per mole AgCl is added to the primitive cubic AgCl emulsion. The emulsion is then chemically sensitized with a gold sensitizing agent as described in U.S. Pat. No. 2,642,316. Thereafter, the emulsion is digested at 70° C.

SD-1

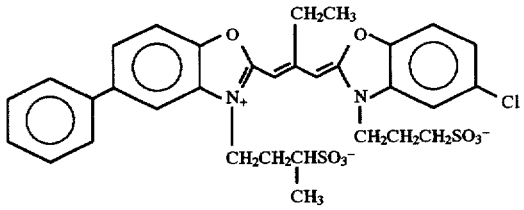

The test coating structure comprising several layers is coated upon a titania pigmented reflection base. The dye-receiving layer comprises polycarbonate and polycaprolactam and is coated first upon this titania pigmented reflection paper base. This titania pigmented paper base is resin coated with high density polyethylene, and is coated with a mixture of polycarbonate, polycaprolactone, and 1,4-didecyloxy-2,5-dimethoxy benzene at a 0.77:0.115:0.115 weight ratio respectively, at a total coverage of 3.28 g/$m^2$.

Four experimental coatings are prepared. Coating 1 serves as a reference check coating and contains no thermal solvent. Coating 2 is prepared with the TS-1 CM dispersion, and serves to illustrate the previously unrecognized problem of desensitization during melt hold by thermal solvent interactions with sensitized silver halide. Coatings 3 and 4 are invention coatings and are prepared with the CM and RM solid particle TS-2 dispersions.

Premelts comprising coupler M-1, most of the gelatin, spreading surfactants, and thermal solvent (if any) are prepared. The above described AgCl emulsion is then added to each of these premelts and held at 40°–45° C. with stirring for 20 minutes before coating. These melts are coated to yield coverages of gelatin at 1.07 g/m$^2$, thermal solvent at 0–1.07 g/m$^2$, coupler M-1 at 729 mg/m$^2$, and green sensitized AgCl at 394 mg Ag/m$^2$. After coating these melts on the support/receiving layer base, an overcoat is applied. This overcoat contains hardener (1,1'-[methylenebis{sulfonyl}] bis-ethene) at a level corresponding to about 1.5% (w/w) of the total gelatin coated (2.14 g/m$^2$) and gelatin at 1.07 g/m$^2$. After coating and chopping, the sensitized strips are exposed on a sensitometer to a tungsten light source through a Wratten 99 filter and a 0 to 3 density 21-step tablet and processed at 35° C. in two different process sequences. Both processing sequences at 35° C. started with 45" development in a developer of the following composition:

| | |
|---|---|
| Triethanolamine | 12.41 g |
| Phorwite REU (Mobay) | 2.3 g |
| Lithium polystyrene sulfonate (30% aqueous solution) | 0.30 g |
| N,N-diethylhydroxylamine (85% aqueous solution) | 5.40 g |
| Lithium sulfate | 2.70 g |
| KODAK Color Developing Agent CD-3 | 5.00 g |
| 1-Hydroxyethyl-1,1-diphosphonic acid (60% aqueous solution) | 1.16 g |
| Potassium carbonate, anhydrous | 21.16 g |
| Potassium bicarbonate | 2.79 g |
| Potassium chloride | 1.60 g |
| Potassium bromide | 7.00 mg |
| Water to make one liter | |
| pH 10.04 ± 0.05 at 27° C. | |

In processing sequence 1, Examples 1–4, development is followed by 45 seconds treatment in a bleach-fix solution, 90" of washing in water, and convective drying. In sequence 2, Examples 5–8, development is followed by 60 seconds treatment in a sulfuric acid stop bath (pH 0.9@27° C.), 60 seconds in a pH 7 buffer, 90 seconds of rinsing in water, and convective drying.

After drying, the coatings of Examples 1–4 are read by status A reflection densitometry for magenta density, and the relative speeds determined in log-exposure (log E) units at densities of 0.1 above Dmin. The relative speeds for Examples 2, 3, and 4 are determined relative to the speed point of Example 1, and are listed in Table 1. The greater than 3 stop desensitization resulting from interactions between the spectrally sensitized emulsion and the TS-1 CM dispersion is evident in the −1.11 logE speed shift observed in Example 2. The solid particle dispersions of TS-2, on the other hand, do not result in any speed loss.

The coatings of Examples 5–8 are heat treated to effect dye diffusion transfer after drying. These dried coatings are laminated with a gel-subbed adhesion sheet of ESTAR as described in U.S. Pat. No. 5,164,280, and passed three times through pinch rollers having surface temperatures of about 110° C. and at 20 psi and about 0.63 cm per second. After the third pass, the adhesion sheet is stripped away, thereby removing the hardened overcoat and imaging layers from the support/receiving layer element. The developed silver and undeveloped silver chloride, contained in the imaging layer, are thereby separated from the dye diffusion image in the receiver layer. The images in the receiver layer of these coatings of Examples 5–8 are then read by status A reflection

TABLE 1

| Example | Coating | Thermal Solvent Dispersion | Δ logE[a] |
|---|---|---|---|
| 1 | 1 | none | — |
| 2 | 2 | TS-1 (CM) Comparison | −1.11[b] |
| 3 | 3 | TS-2 (CM) Invention | +0.03[b] |
| 4 | 4 | TS-2 (RM) Invention | +0.07[b] |
| 5 | 1 | none | — |
| 6 | 2 | TS-1 (CM) Comparison | −1.07[c] |
| 7 | 3 | TS-2 (CM) Invention | +0.21[c] |
| 8 | 4 | TS-2 (RM) Invention | +0.30[c] |

[a]At speed point, 0.1 density units above Dmin;
[b]Relative to speed point of Example 1;
[c]Relative to speed point of Example 5.

densitometry for magenta density, and the relative speeds determined in log-exposure (log E) units at densities of 0.1 above Dmin relative to the speed point of Example 5 that is determined. These relative speeds are listed in Table 1. Similar results as for Examples 1–4 are obtained. The TS-1 CM dispersion in Example 6 yields a −1.07 logE speed shift, while the solid particle dispersions of TS-2, yield speed increases of +0.21 and +0.30 logE in Examples 7 and 8, respectively. These results show that solid particle dispersions of thermal solvents, where said thermal solvents have melting points significantly higher than melt hold and coating temperatures, have less interaction with sensitized silver halide than do dispersions of low-melting thermal solvents.

These examples illustrate how the nanoparticulate thermal solvent dispersions and processes for forming coatings containing such dispersions of the present invention solve a previously unrecognized problem in silver halide emulsion desensitization. It is shown that thermal solvent dispersions can cause dramatic desensitization of spectrally sensitized silver halide emulsion. It is also demonstrated that thermal solvent dispersions of the present invention, namely solid particle thermal solvent dispersions of thermal solvents having melting points above 50° C., can be mixed with such sensitized silver halide emulsions without causing dramatic desensitization, when said mixing is done at temperatures below the melting point of thermal solvent in said solid particle thermal solvent dispersions.

EXAMPLES 9–13

Cyan dye-forming coupler C-1 is dispersed by well known colloid milling methods in aqueous gelatin using DA-9 as a dispersing aid and di-n-butyl phthalate as a coupler solvent. Coupler C-1 and di-n-butyl phthalate are combined at a weight

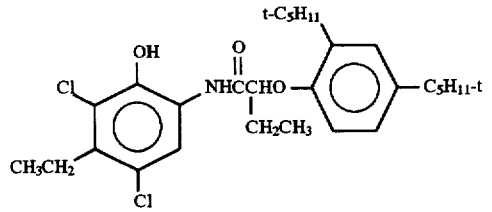

C-1 ratio of about 1:0.5. A dispersion of an oxidized developer scavenger, S-1, is also prepared by similar means. Dispersions of TS-1 and TS-2 (CM) are prepared by colloid milling techniques as described above in Examples 1–8. Two comparison dispersions of TS-3, one by colloid

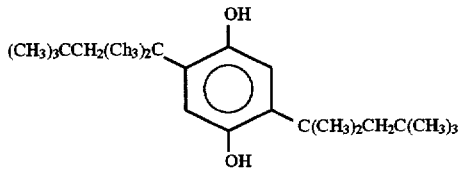

S-1

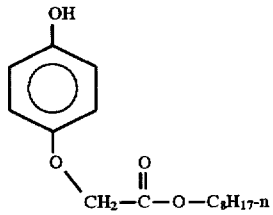

TS-3 milling (CM) and one by roller milling (RM) are prepared similarly as described above for the TS-2 dispersions in Coatings 3 and 4 for Examples 3, 4, 7, and 8. Thermal solvent TS-3 has a melting point in the range of 37°–39° C., and therefore falls outside the scope of the present invention.

The dye-receiving layer and titania pigmented paper base are as described earlier for Coatings 1–4. This polymeric dye-receiving layer is subjected to a corona discharge bombardment within 24 h prior to coating the test elements. These test coatings 5–9 correspond to Examples 9–13, respectively. In the imaging layers coated upon the dye receiving layer, gelatin is coated at 1.07 g/m$^2$, S-1 is coated at 5 mg/m$^2$, thermal solvent is coated at 0–0.86 g/m$^2$, coupler C-1 is coated at 420 mg/m$^2$, and red sensitized AgCl is coated at 198 mg Ag/m$^2$. A protective overcoat of gelatin at 1.07 g/m$^2$ is coated. This overcoat contained hardener (1,1'-[methylenebis{sulfonyl}] bis-ethene) at a level corresponding to about 1.5% (w/w) of the total gelatin coated (2.14 g/m2).

Five experimental coatings are prepared Coating melts are prepared at about 40°–45° C. and these melts are maintained at about 40°–45° C. during the coating operation. Coating 5 serves as a reference check coating and contains no thermal solvent. Coating 6 is prepared with the TS-1 CM dispersion, and serves to illustrate the previously unrecognized problem of severe inhibition of cyan coupling activity during melt hold, coating, storage, and processing by thermal solvent interactions with the cyan coupler dispersion of C-1. Coating 7 is an invention coating prepared with the CM solid particle TS-2 dispersion. Coatings 8 and 9 are comparison coatings that also serve to illustrate the previously unrecognized problem of severe inhibition of cyan coupling activity during melt hold, coating, storage, and processing by thermal solvent interactions with the cyan coupler dispersion of C-1. Coating 8 contains the TS-3 CM dispersion and Coating 9 contains the TS-3 RM dispersion. Coatings 8 and 9 are comparison coatings because melts over the range of 37°–39° C. and is not a thermal solvent of the dispersions, elements, or processes of the present invention; although TS-3 is a solid at room temperature, it is a liquid at normal coating melt hold and coating temperatures of about 40° C.

After coating and chopping, strips of these coatings are exposed on a sensitometer to a tungsten light source through a 0 to 3 density 21-step tablet. Each of these exposed strips was slit into two parallel strips and processed at about 20° C. for 180 seconds development in the developer solution described above and used in Examples 1–8. One of these slit strips was processed in a bleach-fix solution to remove all silver chloride and developed silver to leave only a dye image and the other of each of these slit strips was processed in a fix solution to remove undeveloped silver chloride, but to allow the developed silver to remain. These fixed, but not bleached, strips are read step-wise for developed silver by x-ray fluorescence. The blixed strips are read step-wise by status A reflection densitometry for cyan dye density. Graphs of cyan status A density (OD) versus developed silver (mg Ag/m$^2$) are prepared for each of these coatings, and the initial dye density yield, defined as the slope of these graphs at developed silver levels below 1.11 mg Ag/m$^2$ is determined by linear regression. Correlation coefficients are greater than 0.95 in all of these fits. The corresponding initial dye density yields (DDY) are listed in Table 2 for each of these Coatings 5–9. Dye density yields, under the same processing conditions, are good comparative measures of coupling reactivity, as is detailed by Texter in *J. Photographic Science*, volume 36, pages 14–17 (1988). It is seen that the control coating, Coating 5 (Example 9), has a DDY of 0.015 OD/mg Ag/m$^2$. Example 10 (Coating 6 of the comparison TS-1 CM dispersion) gives a DDY of 0.003 OD/mg Ag/m$^2$, and shows that the presence of TS-1, a liquid at room temperature, during coating melt preparation, coating, and development causes the DDY to fall to about 20% of that obtained in the control coating. Example 11, a coating of an invention dispersion of TS-2, exhibits a DDY of 0.012 OD/mg Ag/m$^2$, nearly as large as the control (Example 9). Examples 12 and 13, CM and RM coatings of TS-3, respectively, also exhibit this severe coupling activity inhibition with DDY of 0.004 and 0.003 OD/mg Ag/m$^2$, respectively. TS-3 is a solid at room temperature, but melts over the 37°–39° C. range, and is therefore liquid during the 40°–45° C. melting and coating operations of the present coating preparations.

These examples illustrate how the dispersions and processes of coating the dispersions of the present invention solve a previously unrecognized problem in cyan

TABLE 2

| Example | Coating | Thermal Solvent Dispersion | DDY[a] (OD/mg Ag/m$^2$)[b] |
|---|---|---|---|
| 9 | 5 | none Control | 0.015 |
| 10 | 6 | TS-1 (CM) Comparison | 0.003 |
| 11 | 7 | TS-2 (CM) Invention | 0.012 |
| 12 | 8 | TS-3 (CM) Comparison | 0.004 |
| 13 | 9 | TS-3 (RM) Comparison | 0.003 |

[a]Initial dye density yield;
[b]Optical density (status A, cyan) per mg developed silver per square meter.

dye forming coupling activity. It is shown that thermal solvent dispersions can cause dramatic inhibition of cyan coupling activity. It is also demonstrated that thermal solvent dispersions of the present invention, namely solid particle thermal solvent dispersions of thermal solvents having melting points above 50° C., can be mixed with and coated with cyan coupler dispersions and obtain significantly greater coupling activity than obtained with comparison thermal solvent dispersions of thermal solvents that have melting points below 50° C. The processing in these examples includes bleaching and fixing steps in order to examine the phenomenon of coupling reactivity, as exemplified by dye density yields (DDY). DDY is defined as the slope of a graph of dye density versus developed silver. Fixing is done in these examples to remove undeveloped silver halide, so that the only silver remaining is due to developed silver. Bleaching and fixing of some of the strips in these examples is done to facilitate the measurement of reflectance optical densities of formed cyan dye, without having to carry out thermal dye diffusion transfer steps of the processes of the present invention. An analysis of the relative reactivities of the cyan dispersion coupling in these examples, and the impact on these reactivities by interactions with thermal solvents, must be done prior to dye diffusion transfer, in order to conform with accepted theory of coupling reactivity, as detailed by Texter in J. Photographic Science, volume 36, pages 14–17 (1988).

The invention has been described in detail with particular reference to preferred embodiments thereof, but it will be understood that variations and modifications can be effected within the spirit and scope of the invention.

What is claimed is:

1. An aqueous solid particle dispersion of a thermal solvent, wherein said thermal solvent is a water-immiscible phenol derivative and has a melting point, $T_m$, between 30° C. and 130° C., wherein said dispersion contains a dispersing aid, and wherein the thermal solvent particles in said dispersion are essentially nanocrystalline.

2. A dispersion as in claim 1 wherein the number-mean size of thermal solvent particles in said dispersion is less than 100 nm in largest dimension.

3. A dispersion as in claim 1, wherein said dispersing aid comprises hydrophilic polymer.

4. A dispersion as in claim 3, wherein said hydrophilic polymer is selected from the group consisting essentially of gelatin, polyvinylalcohol, and polyvinylpyrollidone.

5. A dispersion as in claim 1, wherein said dispersing aid comprises a thickening agent.

6. A dispersion as in claim 1, wherein said dispersing aid is present in said dispersion at a thermal solvent to dispersing aid weight ratio of 1:0.03 to 1:0.3.

7. A dispersion as in claim 1. wherein $T_m$>50° C.

8. A dispersion as in claim 1, wherein said thermal solvent has the structure:

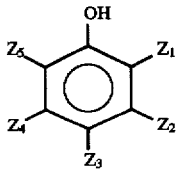

wherein (a) $Z_1$, Z2, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for I is greater than 3 and less than 10.

9. A dispersion as in claim 8, wherein said thermal solvent comprises a 3-hydroxy benzoate or a 4-hydroxy benzoate.

10. A process for forming a coating comprising the steps of:

providing an aqueous solid particle dispersion of thermal solvent, where said thermal solvent is a water-immiscible phenol derivative and has a melting point, $T_m$, between 30° C. and about 200° C., and where said dispersion contains a dispersing aid;

combining said aqueous solid particle thermal solvent dispersion with a coating melt composition, where said coating melt composition is maintained at a temperature, $T_c$, during the preparation and coating of said coating melt composition, and where $T_c<T_m$; coating the combined thermal solvent dispersion and coating melt composition onto a support to form a coating;

drying said coating by means wherein the temperature of said coating is maintained less than $T_m$; and wherein the physical state of thermal solvent in said thermal solvent dispersion is nanocrystalline.

11. A process for forming a coating as in claim 10, wherein the number-mean size of thermal solvent particles in said dispersion is less than 100 nm in largest dimension.

12. A process for forming a coating as in claim 10, wherein said dispersing aid comprises hydrophilic polymer selected from the group consisting essentially of gelatin, polyvinylalcohol, and polyvinylpyrollidone.

13. A process for forming a coating as in claim 10, wherein said dispersing aid comprises a thickening agent.

14. A process for forming a coating as in claim 10, wherein $T_m$>130° C.

15. A process for forming a coating as in claim 14, wherein $T_m$>50° C.

16. A process for forming a coating as in claim 10, wherein $T_m$>50° C.

17. A process for forming a coating as in claim 10, wherein said thermal solvent has the structure:

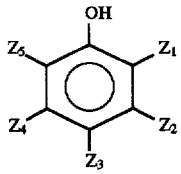

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for I is greater than 3 and less than 10.

18. A process for forming a coating as in claim 10, wherein said thermal solvent comprises at least one 3-hydroxy benzoate or 4-hydroxy benzoate.

19. A process for forming a coating as in claim 10, wherein said coating melt composition comprises a cyan coupler selected from the group consisting of phenol-based cyan couplers and naphthol-based cyan couplers.

* * * * *